US006448900B1

(12) United States Patent
Chen

(10) Patent No.: US 6,448,900 B1
(45) Date of Patent: Sep. 10, 2002

(54) EASY-TO-ASSEMBLY LED DISPLAY FOR ANY GRAPHICS AND TEXT

(76) Inventor: Jong Chen, 5F, 7. Alley 2, Lane 222, Lien Cheng Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/418,124

(22) Filed: Oct. 14, 1999

(51) Int. Cl.[7] ..... G09G 3/14; F21V 5/00
(52) U.S. Cl. ..... 340/815.45; 345/40; 362/800
(58) Field of Search ..... 345/39, 40, 41, 345/44, 46; 362/240, 800; 340/815.45, 815.53

(56) References Cited

U.S. PATENT DOCUMENTS 4,271,408 A * 6/1981 Teshima et al. ..... 340/702
5,151,679 A * 9/1992 Dimmick ..... 340/326
5,574,423 A * 11/1996 Vosika et al. ..... 340/333
5,585,783 A * 12/1996 Hall ..... 340/473
5,663,719 A * 9/1997 Deese et al. ..... 340/912
5,726,535 A * 3/1998 Yan ..... 315/185
5,857,767 A * 1/1999 Hochstein ..... 362/294
6,086,220 A * 7/2000 Lash et al. ..... 362/244
6,204,777 B1 * 3/2001 Lyons ..... 340/908

* cited by examiner

*Primary Examiner*—Bipin Shalwala
*Assistant Examiner*—Nitin Patel
(74) *Attorney, Agent, or Firm*—Dennison, Schultz & Dougherty

(57) ABSTRACT

The invention is an easy-to-assemble LED display driven by a simple circuit for any graphics and text by utilizing a plurality of LED display elements with built-in resistors directly installed on a display with power to light up the LED elements and display texts or graphics. This invention, in particular, allows the user compose different texts or graphics by arranging at will the positions of the LED display elements with built-in resistors on a specific circuit.

6 Claims, 7 Drawing Sheets

EASY-TO-ASSEMBLY LED DISPLAY FOR ANY GRAPHICS AND TEXT

BACKGROUND OF THE INVENTION

1. Field of Invention

The invention relates to an LED display and, in particular, to an easy-to-assemble LED display whose LED display element utilizes multiple built-in resistors and can be directly installed onto a display module with power to display texts or graphics.

2. Background of the Invention

The lighting methods of the LED displays of the prior art can be categorized into two classes: one is the dynamic impulse scanning and the other is the static electrical current driving. Both these two driving methods can achieve the goal of instantaneously changing graphics and texts. However, the driving control circuits are complicated and expensive. Thus, they are not practical when only simple graphics or texts are to displayed and are not changed very often.

Another LED display on the market is realized by imbedding the LEDs onto a display module with fixed texts or graphics, connecting the LEDs with a circuit, and putting on resistors according to the driving voltage. Nevertheless, this application is not flexible and lacks of diversification, it does not meet the need for more varieties of models in limited amount.

Owing to the material and processing, current LEDs have different levels of luminosity and colors; under a certain electrical current, they produce different forward biases because of different internal resistance. The present invention connects LEDs with different resistance with built-in resistors with different resistance in series. In this way, the impedance of each LED display element is about the same and the sum of the potential differences of all the LED display elements on the circuit are roughly equal to the voltage of the power supply when they are driven by a specific current. The built-in resistors and the number of the LED display elements on the circuit should be modified according to the power supply voltage to optimize the gain of tight emission.

In observation of the imperfection of the LED displays of prior an, the inventor did a thorough research and finally presented this easy-to-assemble LED display for any graphics and text that can be driven by simple circuits.

SUMMARY OF THE INVENTION

The present invention provides an easy-to-assemble LED display for any graphics and text that is light and can be driven by a simple circuit. Multiple matrix display modules can be combined in a way that satisfies the user's need.

Furthermore, the instant invention provides an easy-to-assemble LED display for any graphics and text, wherein the LED display element is a package of LED display elements with different resistance connecting to different resistors in series in such a way that the resistance of each LED is roughly the same.

Yet, the invention provides an easy-to-assemble LED display for any graphics and text so that the user can assemble the LED display elements into needed graphics to replace for the signboards made with neon or fluorescent lamps or any signpost with light used on the market, so as to achieve the goal of saving the energy and lowering the cost.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
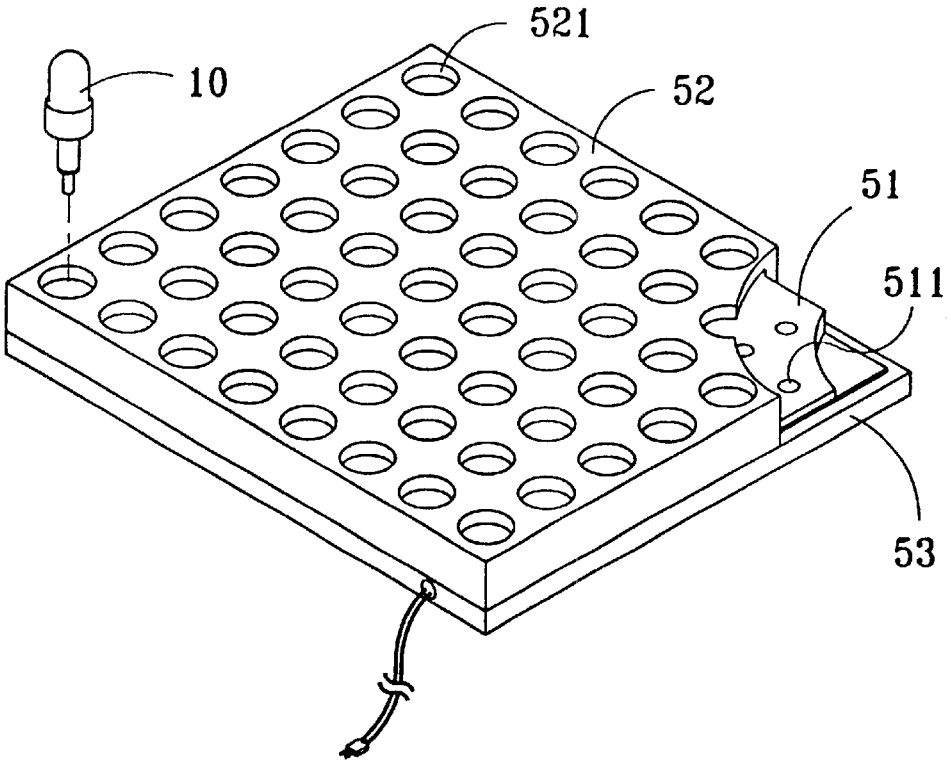
FIG. 1 is a three-dimensional view of a 7×8 matrix module according to the invention.

Please refer to FIG. 1. The circuit of the display board module is made on a printed circuit board into a matrix base 51 enclosed by an upper cover 52 and a lower cover 53. The upper cover has a 7×8 matrix of holes 521 in alignment with the slots 511 on the base 51. Plug LED display elements 10 into the matrix holes 5231 according to the text or graphics to be displayed, and plug resistors R with comparable impedance to the LED display elements 10. The resistors R can be plugged into the holes on the base beforehand.

Figure 2:
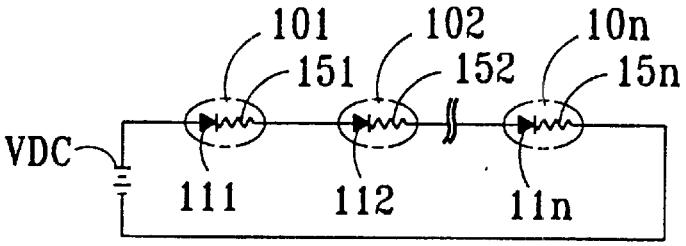
FIG. 2 is a basic driving circuit of the invention.

Please refer to FIG. 2, which is a basic driving circuit of the invention. The power supply has a voltage VDC, the LED display elements on the circuit are 101, 102, . . . 10n, with forward biases Vf1, Vf2, . . . Vfn and internal resistors 151, 152, . . . 15n with resistance R1, R2, . . . Rn, respectively.

The driving voltage VDC is divided into n voltage drops with each equal to VDC/n. VDC/n>Vfmax, where Vfmax is the maximal forward bias of various LEDs used in the display module. For example, the driving current is If, then each LED with the forward bias Vf needs to be connected to a resistor with resistance R=(VDC/n−Vf)/If. In this way, the LED display element connecting to the resistor can be replaced in the display module at one's will. Thus, when the driving current is set to be I, the total impedance of the driving circuit is $$\frac{V_{DC}}{I},$$

the internal resistance of the LEDs are $$\frac{V_{f1}}{I},$$

$$\frac{V_{f2}}{I} \cdots \frac{V_{fn}}{I}.$$

We have, according to theory, $$\frac{V_{DC}}{nI} \approx \frac{V_{f1}}{I} + R_1 \approx \frac{V_{f2}}{I} + R_2 \ldots \approx \frac{V_{fn}}{I} + R_n$$

where "≈" means equal or approximately equal. Therefore, different LEDs 111–11n can be packaged into the LED display elements 10 with equal or approximately equal impedance with the help of built-in resistors, and can be replaced in this serial circuit.

Figure 3:
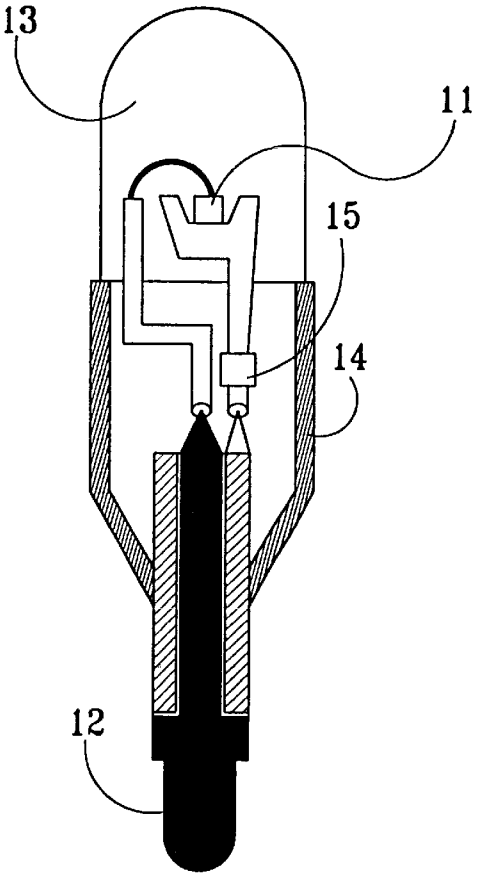
FIG. 3 is a cross section of an LED display element with built-in resistors according to the invention.
Figure 4:
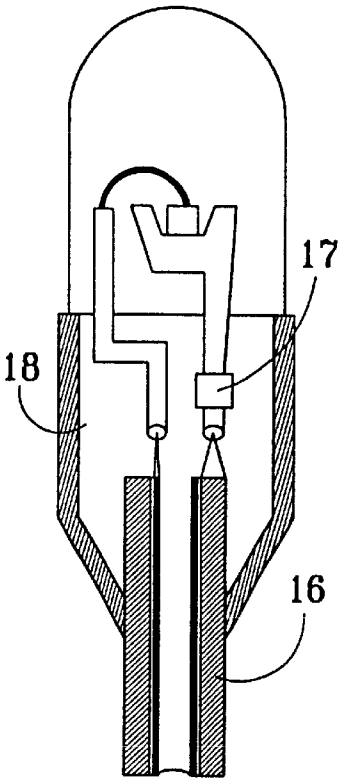
FIG. 4 is another type of LED display element.

Please refer to FIG. 3, which is a cross section of an LED display element with built-in resistors according to the invention. It is mainly composed of the LEDs 11, pins 12, the first resin 13, the second resin 14, and internal resistors 15. The first resin 13 is transparent or can be painted with dye of the same color as that of the LEDs 11. In bright environment, the LEDs 11 have similar visual effect even if they are off . The second resin can fix the pins 12 and internal resistors 15. The size of the internal resistor 15 is determined by the number of serial LED display elements 10 on the circuit, power supply voltage, and the forward biases of various LEDs 11. FIG. 4 shows another type of LED display element, the socket 16 takes the fashion of matching. The built-in resistors 17 are serially connected within and packaged with the transparent resin 18, in the same manner as in FIG. 3.

Figure 5A:
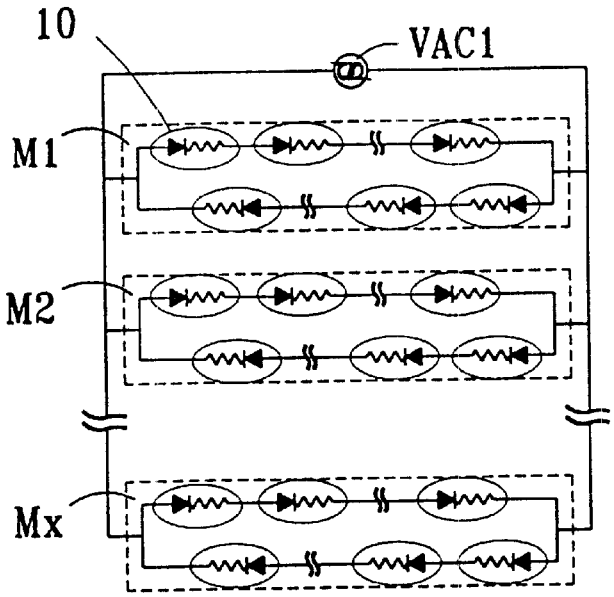
FIG. 5A is an actual circuit of a display composed of multiple matrix modules driven by alternative currents according to the invention.

Please refer to FIG. 5A, which is an actual circuit of a display composed of multiple matrix modules driven by alternative currents according to the invention. The AC power supply has voltage VAC1 and each of the modules M1, M2, . . . Mx is consisted by two series of equal number of LED display elements 10 with opposite polarities. All LED display elements 10 are adjusted via the corresponding built-in resistors to obtain roughly equal impedance. Driven by a specific current (about 20 mA), the total potential difference of all modules equals or roughly equals VAC1. When VAC1 is positive, only the series of display elements with positive polarity in the module is lit up; while when VAC1 reverses, only the other series is lit up instead. If the frequency of VAC1 is shorter than the period of human temporary visual image retention, human eyes will not notice the alternative flashes of the LEDs.

Figure 5B:
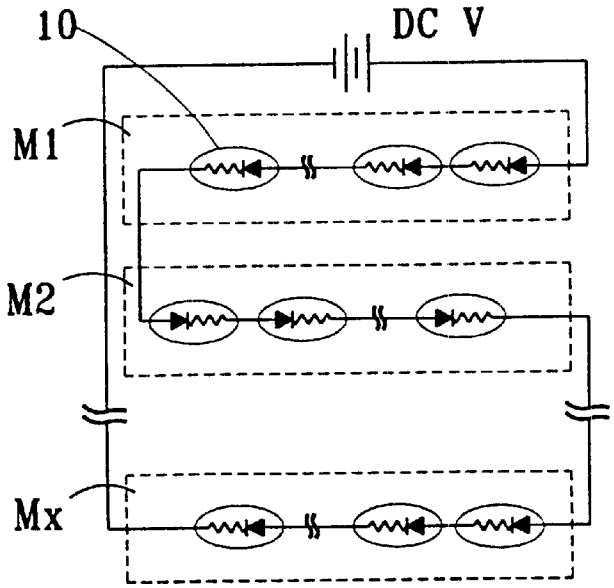
FIG. 5B is an actual circuit of a display composed of multiple matrix module driven by direct currents according to the invention.

Please refer to FIG. 5B. We can also connect modules M1, M2, . . . Mx, with each LED display element in each module adjusted by the built-in resistor to make roughly equal impedance. The total potential difference of all modules driven by a specific current equals or roughly equals the DC power supply voltage. When the current flows through each module, we can produce various texts or graphics by the way the modules or the LED display elements are arranged. Therefore, different texts and graphics can be flexibly displayed with either a DC or an AC power supply.

Figure 6:
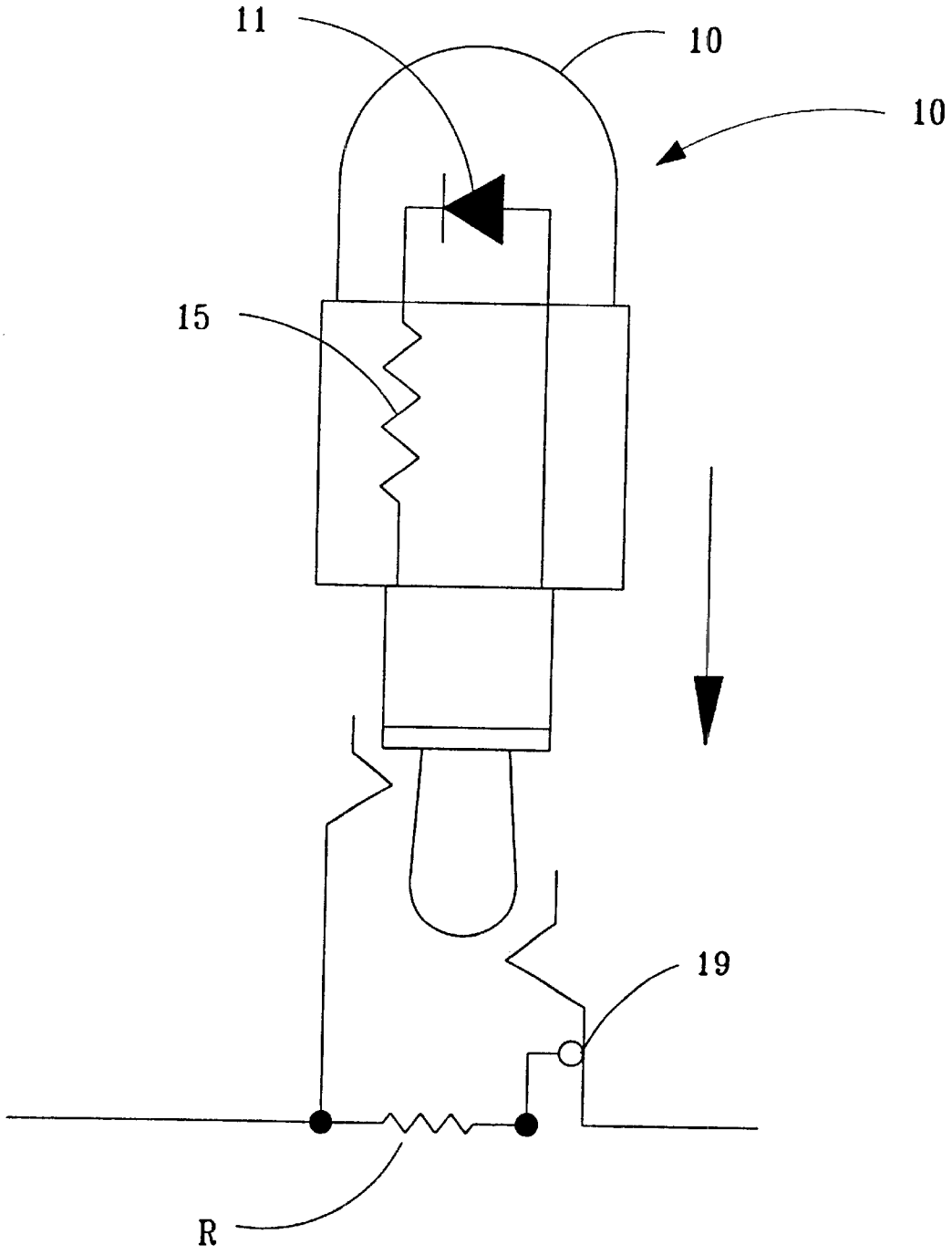
FIG. 6 is an illustrative diagram of the invention using a spring chip switch.
Figure 7:
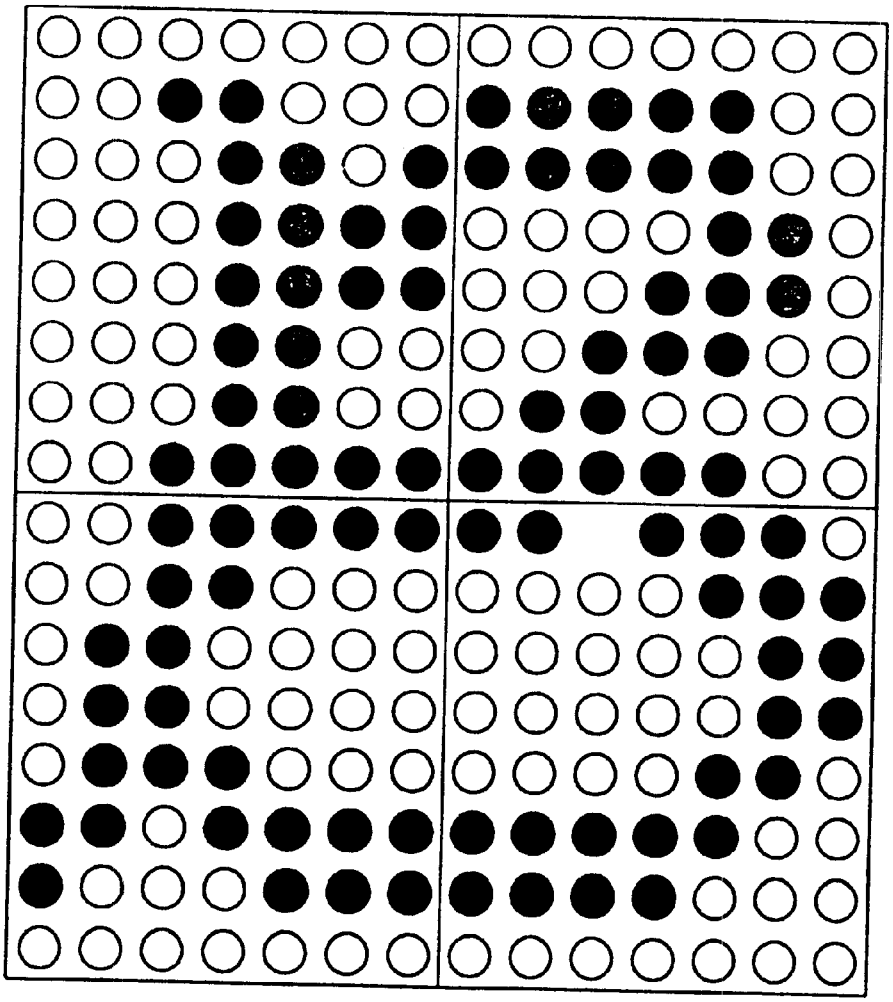
FIG. 7 is a functional plot of the invention with four 7×8 matrix modules.

Please refer to FIG. 6. The spring chip switch 19 under the hole of the display board module is used as a switching device. When no LED display element 10 is plugged into the hole, the current will flow through this resistor and forms a closed loop; whereas if an LED display element 10 is inserted, the spring chip switch 19 will be disconnected from the circuit and get into contact with the positive and negative poles, allowing the current flow through the LED display element 10 but not the resistor R. A display with a larger area can be constructed by connecting multiple modules in parallel in such a method. FIG. 7 is an illustrative finctional plot of the invention with four 7×8 matrix modules.

Figure 8:
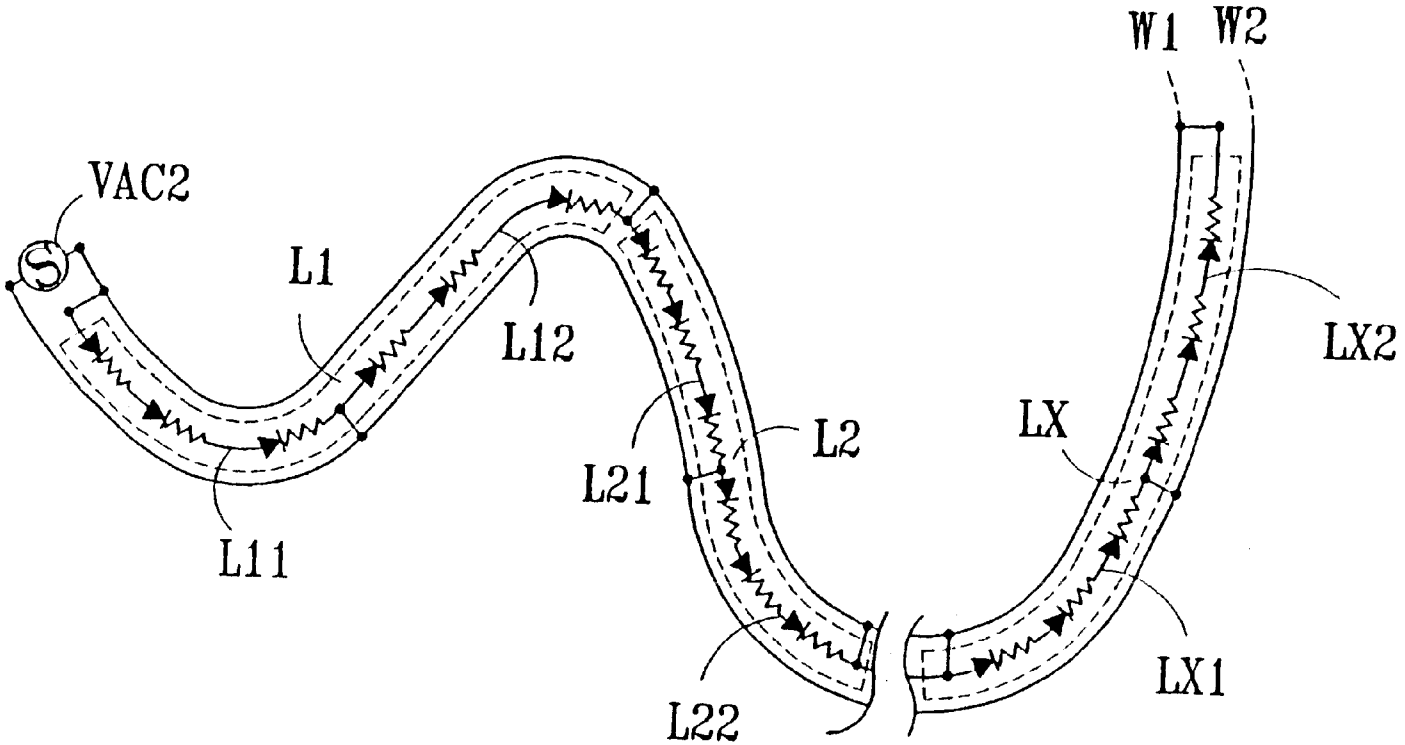
FIG. 8 is an actual circuit of a display composed of multiple linear modules driven by direct currents according to the invention.

Please refer to FIG. 8, which is an actual circuit of a display composed of multiple linear modules driven by direct currents according to the invention. The AC power supply has voltage VAC2, the power cords are W1 and W2. The linear modules L1, L2, . . . Lx are composed by connecting L11, L12, L21, L22, . . . Lx1, and Lx2 in series, respectively. The beginning of L1, L2 and the end of Lx are connected to W1, while the connecting points between L11 and L12, L21 and L22, . . . Lx1 and Lx2 are connected to W2; wherein each of L11, L12, L21, L22, . . . Lx1, Lx2 consists of n LED display elements 10 connecting in series. The total potential difference of each series driven under a specific current (about 20 mA) equals or roughly equals VAC2. When W1 is positive, only L12, L22, . . . Lx2 are lit up. The LED display elements 10 in this linear module can be fixed to positions as needed, which is economical and convenient.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An easy-to-assemble LED display driven by a simple circuit for any graphics and text by utilizing a plurality of LED display elements with built-in resistors directly installed on a display with power to light up the LED elements and display texts or graphics, allowing the user compose different texts or graphics by arranging at will the LED display elements with built-in resistors on a specific circuit, which LED display comprises:

a matrix display module, wherein the circuit of said module is a matrix base with a plurality of socket holes made by a printed circuit board covered by an upper cover and a lower cover and said upper cover has a matrix of holes in alignment with said plurality of socket holes on said base, wherein said matrix of holes are inserted with said LED display elements in the area of the text or graphics to be displayed while with resistors of comparable impedance to that of said LED display elements in the area not be lit up;

a display element, which has an equal or roughly equal impedance to that of said LED display element that is formed by connecting LEDs and said built-in resistors in series; and a modularized LED display element installation circuit, which is a circuit compatible to said LED display elements wherein the impedance of each of said LED display elements is designed to be equal or roughly equal to the power supply voltage divided by the number of said LED display and the value of the driven current.

2. An easy-to-assemble LED display driven by a simple circuit for any graphics and text as of claim 1, wherein said matrix module may be composed of two series of equal number of said LED display elements with opposite polarities, each of said LED display elements in said matrix display module is adjusted by said built-in resistor to make the impedance roughly the same and a plurality of said matrix display modules can be connected in parallel into a display so that only said LED display elements in said modules with a positive polarity are lit up when the AC power voltage is positive and only those with a negative polarity are lit up when the AC power voltage is negative.

3. An easy-to-assemble LED display driven by a simple circuit for any graphics and text as of claim 1, wherein each of said LED display elements in each of said modules is adjusted by said built-in resistor connected in series to make the impedance roughly the same and the total potential difference of each of said modules driven by a specific current equals or roughly equals the DC power voltage so that different texts or graphics can be displayed by adjusting the arrangement of said modules or the positions of said LED display elements when said current flows through each of said modules.

4. An easy-to-assemble LED display driven by a simple circuit for any graphics and text as of claim 1, wherein a plurality of said LED display elements may form a linear display module in which each of said LED display element is adjusted by said built-in resistor to make the impedance roughly the same and a plurality of said linear display modules can be connected in parallel into a display so that only half of said LED display elements in said linear module are lit up when the AC power voltage is positive and only the other half of said LED display elements in said linear module are lit up when the AC power voltage is negative.

5. An easy-to-assemble LED display driven by a simple circuit for any graphics and text as of claim 1, wherein said built-in resistors can be connected to one of the front and rear ends of said LED in series.

6. An easy-to-assemble LED display driven by a simple circuit for any graphics and text as of claim 1, wherein said resistors with impedance equal to that of said display elements are installed beforehand into said plurality of socket holes so that, with the spring chip switches, the current flows through said resistors when no display element is inserted, whereas the current flows through said display elements but not said resistors when said display elements are inserted to disconnect said spring chip switches from said resistors.

* * * * *